US008506405B2

(12) United States Patent
Allen et al.

(10) Patent No.: US 8,506,405 B2
(45) Date of Patent: Aug. 13, 2013

(54) MEDIA PROCESSING MECHANISM FOR WAGERING GAME SYSTEMS

(75) Inventors: Jeffrey L. Allen, Naperville, IL (US); Mark B. Gagner, West Chicago, IL (US); Damon E. Gura, Chicago, IL (US); Krishnakumar Meluveettil, Naperville, IL (US); Richard B. Robbins, Glenview, IL (US); Richard T. Schwartz, Chicago, IL (US); Matthew J. Ward, Northbrook, IL (US)

(73) Assignee: WMS Gaming, Inc., Waukegan, IL (US)

( * ) Notice: Subject to any disclaimer, the term of this patent is extended or adjusted under 35 U.S.C. 154(b) by 335 days.

(21) Appl. No.: 12/940,987

(22) Filed: Nov. 5, 2010

(65) Prior Publication Data

US 2011/0111862 A1 May 12, 2011

Related U.S. Application Data

(60) Provisional application No. 61/258,879, filed on Nov. 6, 2009.

(51) Int. Cl.
*A63F 9/24* (2006.01)

(52) U.S. Cl.
USPC ..... 463/42; 463/21; 463/16

(58) Field of Classification Search
None
See application file for complete search history.

(56) References Cited

U.S. PATENT DOCUMENTS

| | | | | |
|---|---|---|---|---|
| 6,626,761 | B1 | 9/2003 | Okada | |
| 7,744,453 | B2 | 6/2010 | Pacey | |
| 2002/0082082 | A1 * | 6/2002 | Stamper et al. | 463/32 |
| 2003/0003988 | A1 * | 1/2003 | Walker et al. | 463/21 |
| 2003/0211889 | A1 * | 11/2003 | Walker et al. | 463/42 |
| 2004/0219980 | A1 * | 11/2004 | Bassett et al. | 463/33 |
| 2005/0054442 | A1 * | 3/2005 | Anderson et al. | 463/35 |
| 2006/0009286 | A1 * | 1/2006 | Durham et al. | 463/30 |
| 2006/0111171 | A1 * | 5/2006 | Berg et al. | 463/16 |
| 2007/0015564 | A1 * | 1/2007 | Walker et al. | 463/16 |
| 2007/0060247 | A1 * | 3/2007 | Low et al. | 463/16 |
| 2007/0087832 | A1 * | 4/2007 | Abbott et al. | 463/42 |
| 2007/0191111 | A1 | 8/2007 | Sylla et al. | |
| 2008/0076546 | A1 * | 3/2008 | Moyle et al. | 463/29 |
| 2008/0113777 | A1 * | 5/2008 | Anderson | 463/25 |
| 2008/0176637 | A1 * | 7/2008 | Letovsky et al. | 463/20 |
| 2008/0280676 | A1 * | 11/2008 | Distanik et al. | 463/29 |
| 2008/0318655 | A1 | 12/2008 | Davies | |

(Continued)

FOREIGN PATENT DOCUMENTS

| | | |
|---|---|---|
| WO | WO2009020843 | 2/2009 |
| WO | WO2009123972 | 10/2009 |
| WO | WO2009134909 | 11/2009 |

*Primary Examiner* — Paul A D'Agostino

(74) *Attorney, Agent, or Firm* — DeLizio Gilliam, PLLC

(57) ABSTRACT

A wagering game system and its operations are described herein. In some embodiments, the operations can include transmitting game content from a wagering game server to a gaming machine via a network to present a wagering game at the gaming machine for a player, and generating and storing video of one or more rounds of the wagering game. The operations can also include receiving, at the wagering game server via the network, video of the player playing the one or more rounds of the wagering game. The operations can further include combining the video of the one or more rounds of the wagering game with the video of the player playing the one or more rounds of the wagering game, and storing and providing access to the combined video via the network to a player account associated with the player.

23 Claims, 8 Drawing Sheets

(56) References Cited

U.S. PATENT DOCUMENTS

| | | | | |
|---|---|---|---|---|
| 2009/0111578 | A1* | 4/2009 | Griswold et al. | 463/31 |
| 2009/0124376 | A1* | 5/2009 | Kelly et al. | 463/29 |
| 2009/0325690 | A1* | 12/2009 | Zhou et al. | 463/29 |
| 2010/0048302 | A1* | 2/2010 | Lutnick et al. | 463/42 |
| 2010/0075757 | A1* | 3/2010 | Hein | 463/40 |
| 2010/0203963 | A1 | 8/2010 | Allen et al. | |
| 2010/0234105 | A1 | 9/2010 | Gagner et al. | |
| 2010/0255900 | A1 | 10/2010 | Ansari et al. | |

* cited by examiner

MEDIA PROCESSING MECHANISM FOR WAGERING GAME SYSTEMS

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to a media processing mechanism for wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Traditionally, wagering game machines have been confined to physical buildings, like casinos (e.g., major casinos, road-side casinos, etc.). The casinos are located in specific geographic locations that are authorized to present wagering games to casino patrons. However, with the proliferation of interest and use of the Internet, some wagering game manufacturers have recognized that a global public network, such as the Internet, can reach to various locations of the world that have been authorized to present wagering games. Consequently, some wagering game manufacturers have created wagering games that can be processed by personal computing devices and offered via online casino websites ("online casinos").

BRIEF DESCRIPTION OF THE FIGURES

Embodiments are illustrated in the Figures of the accompanying drawings in which.

DESCRIPTION OF THE EMBODIMENTS

This description of the embodiments is divided into five sections. The first section provides an introduction to some embodiments, while the second section describes example wagering game machine architectures. The third section describes example operations performed by some embodiments and the fourth section describes example wagering game machines in more detail. The fifth section presents some general comments.

Introduction

This section provides an introduction to some embodiments.

Wagering game systems offer wagering game players ("players") entertainment value and the opportunity to win monetary value. In various embodiments, wagering game systems can try to enhance the gaming experience by generating media (e.g., video and/or audio) and other content associated with wagering games played by players via the wagering game system, and allowing the players to edit the media and share the media with friends. In some implementations, the wagering game system can generate and store video and/or audio of one or more rounds of the wagering game played by a player at a gaming machine; for example, it can generate and store video of the game content (e.g., game elements, game results, etc.) displayed to the player during the one or more rounds of the wagering game. The wagering game system may use a camera to capture and store video and/or audio of the player playing the one or more rounds of the wagering game at the gaming machine. In some implementations, the wagering game system can edit the media associated with the wagering game to enhance the media that is made available for the player, as will be further described below with reference to FIGS. 1-6. For example, the wagering game system can combine different media; e.g., it can combine video and/or audio of the wagering game with video and/or audio of the player playing the wagering game. The wagering game system can also add content to the media, e.g., edit video associated with a wagering game to add an indication (e.g., text, graphics, or a video clip) of what the result of the next round would have been if the player did not end the wagering game session. In some implementations, the wagering game system can also allow the player to edit the media to personalize and customize the media; e.g., it can add text, markings, voice-over commentary, etc. to the video, and allow the player to share the media (e.g., upload the media to a gaming community website, a social networking website, etc.).

It is noted that additional examples of generating and enhancing media associated with wagering games, and various related applications, will be described below. It is further noted that the mechanism and techniques described herein can be implemented for media generated in both online wagering game systems (e.g., online casinos) and physical wagering game systems (e.g., brick and mortar casinos).

Figure 1:
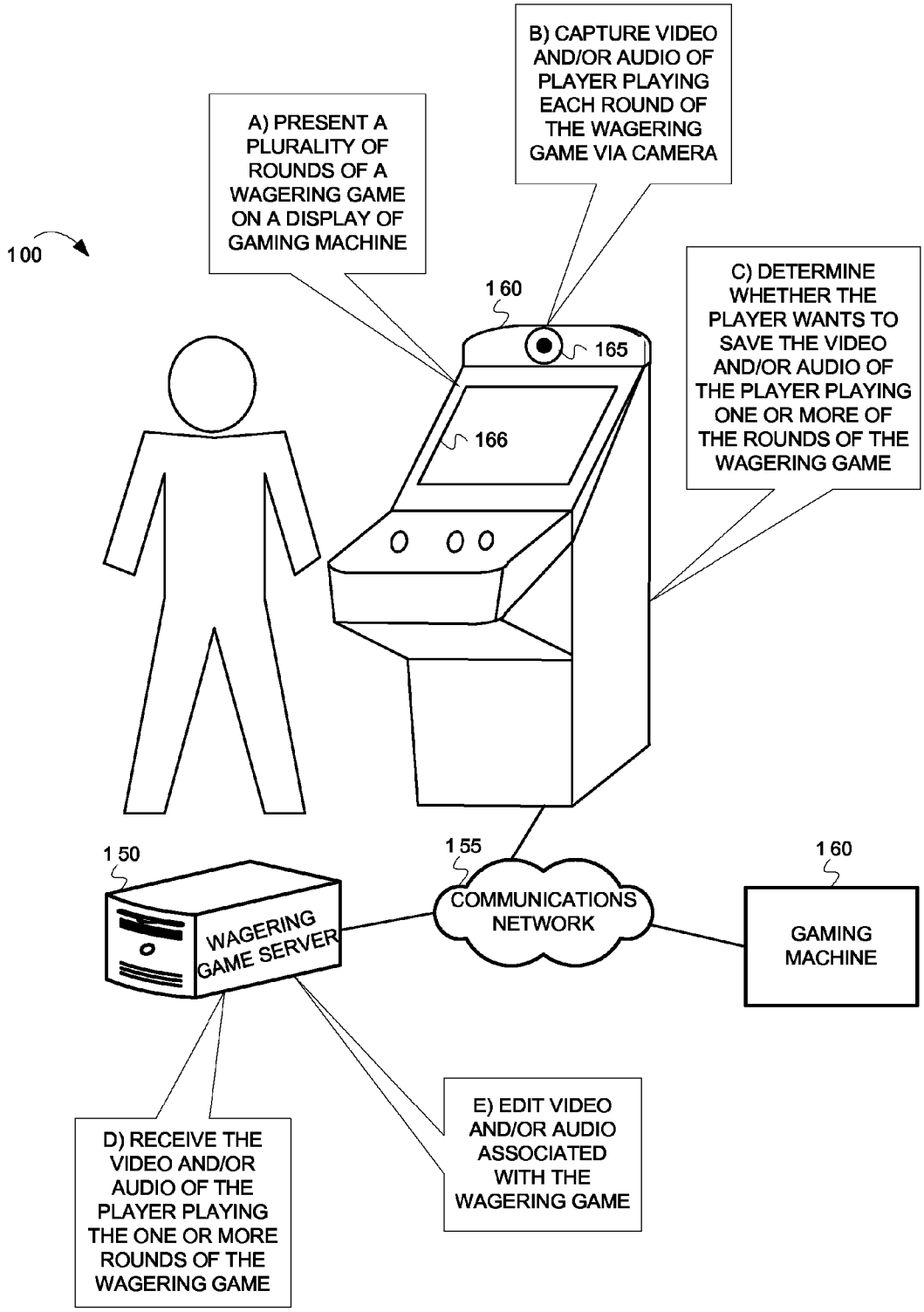
FIG. 1 is a conceptual diagram illustrating an example of generating and enhancing media associated with a wagering game played by a player in a wagering game system, according to some embodiments.

FIG. 1 is a conceptual diagram illustrating an example of generating and enhancing media associated with a wagering game played by a player in a wagering game system, according to some embodiments. In the example shown in FIG. 1, the wagering game system ("system") 100 includes a wagering game server 150 connected to one or more wagering game machines ("gaming machines") 160 via a communications network 155.

In one implementation, at stage A, a gaming machine 160 presents a plurality of rounds of a wagering game on a display 166 of the gaming machine 160. For example, in response to a player initiating a wagering game session on the gaming machine 160, selecting the wagering game, and providing input during game play (e.g., bet amount, button presses, touch screen selections, etc.), the gaming machine 160 can communicate with the wagering game server 150 to present the rounds of the wagering game (e.g., slots, video poker, video blackjack, video roulette, etc.) and determine the game results.

At stage B, the gaming machine 160 captures video and/or audio of the player playing each round of the wagering game. In one implementation, the gaming machine 160 can include a camera 165 positioned to capture the player playing the wagering game in the camera's field of vision. The camera 165 can capture a player's facial expressions during game play and after a win or loss, and the player's celebration after a big win. The camera 165 can also capture other objects and people that are in the camera's field of vision, e.g., friends, family members, or bystanders celebrating along with the player. In one implementation, the gaming machine 160 can obtain permission from the player to capture video of the player playing the wagering game at the beginning of the wagering game session. In another implementation, the gaming machine 160 can inform the player and provide the player the option to trigger the start of the audio/video recording, e.g., by pressing a button, selecting a menu option, etc. on the gaming machine 160. In one example, the player may trigger the start of the audio/video recording via a mobile device, as will be further described below with reference to FIG. 2. It is noted that in other embodiments the gaming machine 160 can include two or more cameras positioned to capture different views of the player playing the wagering game. Furthermore, in other implementations, cameras mounted externally to the gaming machine 160 (e.g., overhead cameras, cameras for a bank of wagering game machines, etc.) can capture video of the player playing the wagering game in a casino environment.

At stage C, the gaming machine 160 determines whether the player wants to save the video and/or audio of the player playing one or more rounds of the wagering game in order to be accessible by the player in the future. In one implementation, the gaming machine 160 can temporarily store the media associated with the wagering game locally at the gaming machine 160. During the wagering game session, the gaming machine 160 can determine whether the player wants to save the media at a location external to the gaming machine 160 (e.g., at the wagering game server 150, in order for the player to access the media at a later time via a network, such as the Internet). For example, at the end of the wagering game session, the gaming machine 160 can present the player the option to save (e.g., at the wagering game server 150) the video and/or audio of the player playing the rounds of the wagering game that was captured during the wagering game session. The gaming machine 160 can also provide the player the option to save only portions of the video and/or audio; e.g., it can allow the player to save only video of a subset of the rounds that the player played during the wagering game session, such as the rounds that the player won a relatively large monetary award. In one implementation, at the end of each round of the wagering game, the gaming machine 160 can ask the player to indicate whether the player wants to save the video and/or audio of that particular round. In another implementation, the gaming machine 160 can present a summary screen at the end of the wagering game session that allows the player to select which of the rounds of wagering game to save to the wagering game server 150. For example, the gaming machine 160 can display information about each round (e.g., amount won, amount bet, etc.) and the player can select or place a check mark next to each round that the player wants to save. In another example, the gaming machine 160 can allow the player to specify criteria about the rounds of the wagering game the player wants to save; e.g., the player can specify to save rounds of the wagering game where the player won at least a specified amount of money or game credits.

In one implementation, in order for the gaming machine 160 to search through and identify specific rounds of the wagering game, a media processing mechanism of the gaming machine 160 can add markers to the video and/or audio captured by the camera 165 at the start of each of the rounds played by the player, and store information associated with each round, e.g., amount won, amount bet, and other game-related information. In one example, the markers are embedded in between each round to indicate the end of one round and the beginning of the next round. In another implementation, the gaming machine 160 may allow the player to request a replay of some or all of the rounds of the wagering game in order to select which of the rounds to save to the wagering game server 150. If the gaming machine 160 determines that the player wants to store some or all of the video and/or audio captured during the wagering game session, the gaming machine 160 provides the video and/or audio to the wagering game server 150 via the network 155. It is noted, however, that in some implementations the gaming machine 160 can automatically provide all of the media associated with the wagering game to the wagering game server 150, and the player can specify at a later time (e.g., when the player accesses the media at the wagering game server 150) which content the player wants to delete and which content the player wants to save, edit, share, etc. Furthermore, in other implementations, at any given time during the wagering game session, the player can specify at the gaming machine 160 to save (e.g., at the wagering game server 150) the previous 5 minutes, 10 minutes, or any other suitable time period of video that was captured of the player playing the wagering game.

Figure 2:
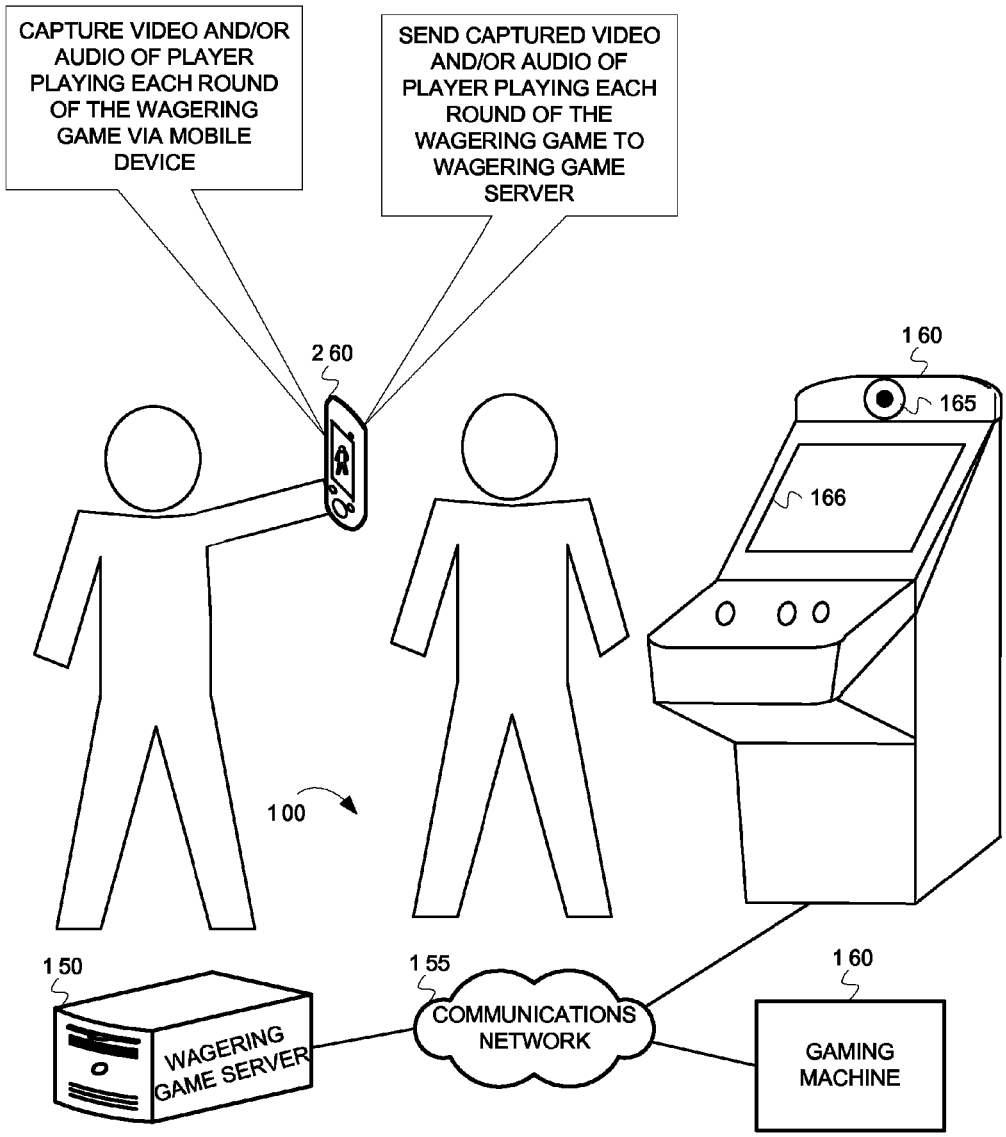
FIG. 2 is a conceptual diagram illustrating another example of generating and enhancing media associated with a wagering game played by a player in a wagering game system, according to some embodiments.
Figure 3:
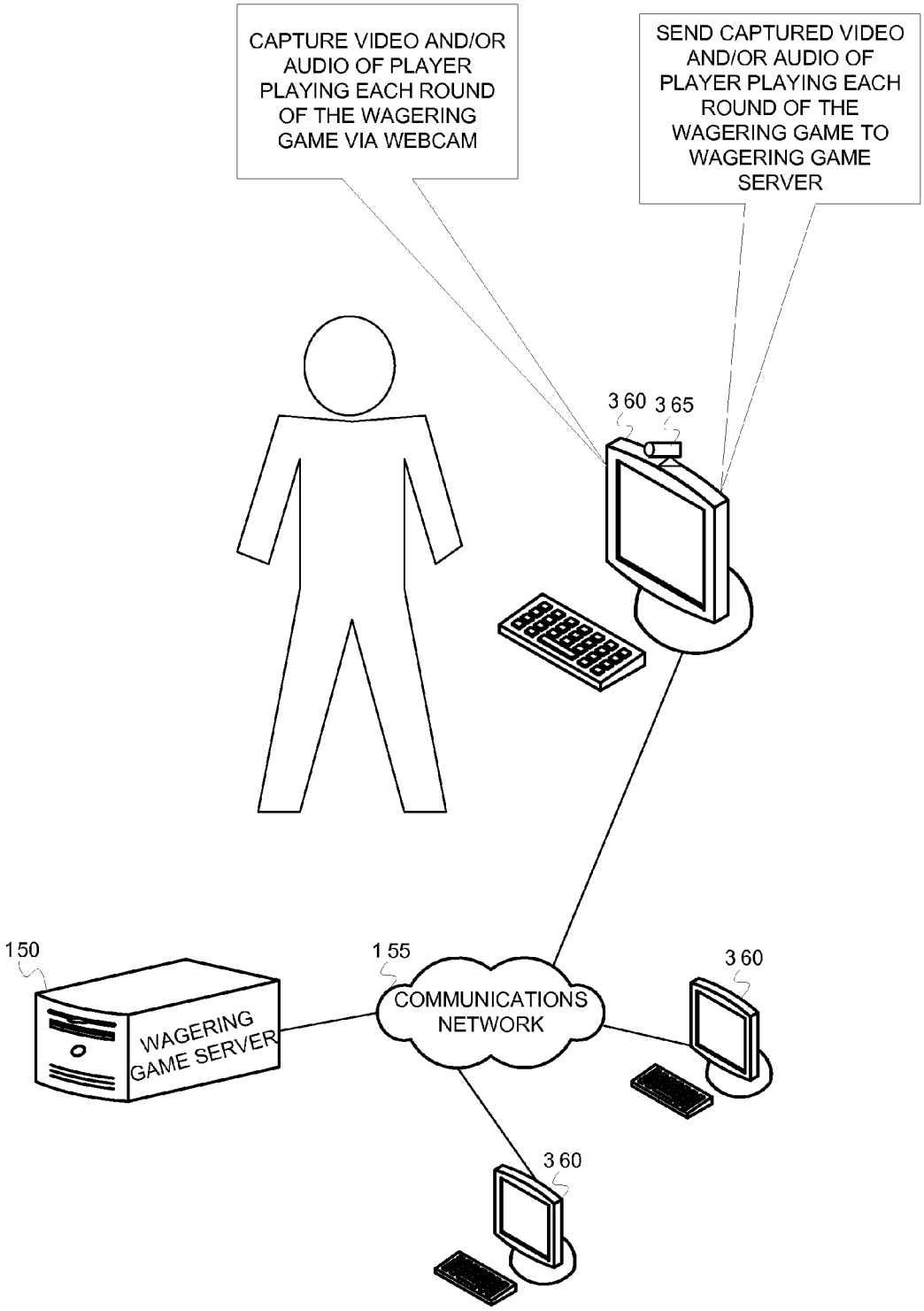
FIG. 3 is a conceptual diagram illustrating another example of generating and enhancing media associated with a wagering game played by a player in a wagering game system, according to some embodiments.

It is further noted that in other implementations, the video and/or audio associated with the wagering game played by the player can be captured and processed by other methods, e.g., as shown in FIGS. 2 and 3. In the example of FIG. 2, the video and/or audio of the player playing the rounds of the wagering game can be captured using a camera on a mobile device 260. For example, the player can have a friend (or other person) capture video of the player playing the wagering game on a gaming machine 160 using the player's mobile device 260. The mobile device 260 can be various types of portable devices that include video and/or audio capture capabilities, e.g., a mobile phone, a digital camera, a media player, etc. The mobile device 260 can then provide the video and/or audio of the player playing the wagering game to the wagering game server 150. For example, the mobile device 260 can include an application or other software program, which can be downloadable from the wagering game server 150, to communicate with the wagering game server 150. The mobile device 260 can transmit the media to the wagering game server 150 wirelessly, or the player can connect the mobile device 260 to a wired network (e.g., at home or in a casino) to transmit the media to the wagering game server 150. In another example, the downloadable application associated with the wagering game system may allow the player to wirelessly communicate with the gaming machine 160 to trigger the start/stop of the recording (e.g., via camera 165) of the player playing the wagering game at any point in time during the wagering game session. Furthermore, as shown in the example of FIG. 3, the capture and processing of media associated with a wagering game played by a player can be accomplished outside of a physical casino. FIG. 3 illustrated a plurality of client gaming machines 360 connected to the wagering game server 150 via the communication network 155. In one implementation, the player can capture video and/or audio of the player playing a wagering game (e.g., at home or other location outside of a physical casino) via a camera 365 (e.g., a webcam) linked or otherwise connected to a gaming machine 360. The player can participate in a wagering game taking place within a physical casino remotely via the Internet, or the player can play a wagering game at an online casino. The gaming machines 360 can be various types of devices that can connect to the communication network 155 (e.g., the Internet) and incorporate a camera. For example, the gaming machines 360 can be a personal computer (PC), a laptop, a workstation, etc. In some implementations, the wagering game server 150 can be tied to one or more physical casino networks, and/or to one or more online casino environments. It is noted that in some implementations, the gaming machines shown in FIGS. 1-3 may offer players the option to capture still images instead of capturing video and audio using the camera. The gaming machines can similarly provide the still images to the wagering game server 150 to be saved, edited, shared, etc.

Returning to FIG. 1, at block D, the wagering game server 150 receives video and/or audio of the player playing the one or more of the rounds of the wagering game from the wagering game server 150. The wagering game server 150 stores the media and makes it accessible to the player via the network 155. For example, the wagering game server 150 can store the media such that it's accessible by the player via the player's wagering game account, e.g., provide a link to the media within the player's wagering game account. The wagering game server 150 can also store the media in a gaming community website that offers members of a gaming community access to wagering games, game-related content, social networking features, etc.

At block E, the wagering game server 150 can edit the video and/or audio associated with the wagering game played by the player. In some implementations, the wagering game server 150 can automatically edit the media received from the gaming machine 160 to offer players access to enhanced media content. For example, the wagering game sever 150 can combine different media, e.g., overlay video and/or audio of the wagering game with video and/or audio of the player playing the wagering game. The wagering game system can also add content to the media, e.g., edit video associated with a wagering game to add an indication (e.g., text, graphics, or a video clip) of what the result of the next round would have been if the player did not end the wagering game session, e.g., as will be described further below with reference to FIGS. 5-6. In some implementations, the wagering game server 150 can edit the media according to input received from the player. In one example, the wagering game server 150 can provide an online media editing tool to allow the players to personalize and customize the video and/or audio, e.g., add text captions, voice-over commentary, markings, etc., as will be described further below with reference to FIGS. 5-6. The wagering game server 150 can also allow the player to share the media, e.g., share the media with members of a gaming community website, post the media in a social networking website, etc.

Although FIGS. 1-3 describes some embodiments, the following sections describe many other features and embodiments.

Operating Environment

This section describes example operating environments and networks and presents structural aspects of some embodiments. More specifically, this section includes discussion about wagering game system architectures.

Wagering Game System Architectures

Figure 4:
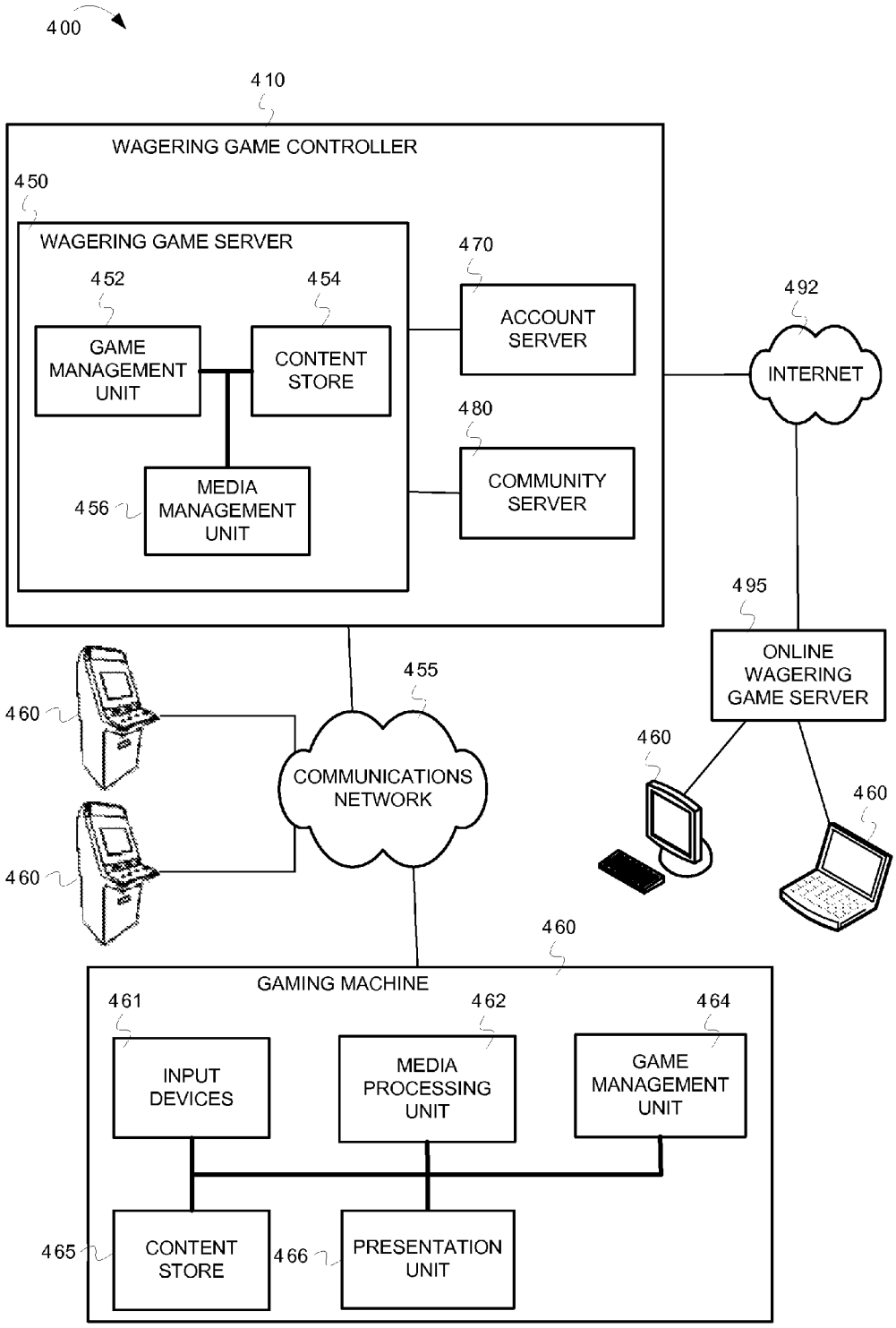
FIG. 4 is a conceptual diagram that illustrates an example of a wagering game system architecture, according to some embodiments.

FIG. 4 is a conceptual diagram that illustrates an example of a wagering game system architecture 400, according to some embodiments. As illustrated, the wagering game system architecture 400 includes a wagering game controller 410 and a plurality of gaming machines 460. The wagering game controller 410 is configured to control game content (e.g., game elements and results) and communicate game-related information and other information (e.g., social networking services) to and from the plurality of gaming machines 460. In one embodiment, the wagering game controller 410 comprises a wagering game server 450, an account server 470, and a community server 480. In some embodiments, the wagering game controller 410 may be configured to communicate with other systems, devices, and networks. For example, the wagering game controller 410 may be configured to communication with one or more additional physical casinos, and/or an online wagering game server 495 that implements an online casino.

The wagering game server 450 is configured to manage and control content for presentation on the gaming machines 460. For example, the wagering game server 450 includes a game management unit 452 configured to provide (e.g., stream) game content and other game-related information to the gaming machines 460 during a wagering game session. The game management unit 452 is configured to generate (e.g., using a random numbers generator) game results (e.g., win/loss values), including win amounts, for wagering games played on the gaming machines 460. The game management unit 452 can communicate the game results to the gaming machines 460 via the network 455. In some implementations, the game management unit 452 can also generate random numbers and provide them to the gaming machines 460 so that the gaming machines 460 can generate game results. The wagering game server 450 can also include a content store 454 configured to store content used for presenting wagering games (e.g., base wagering games, secondary bonus games, etc.) and other information on the gaming machines 460. The wagering game server 450 can also include a media management unit 456 configured to receive and store video and/or audio associated one or more wagering games played by players, edit the video and/or audio, and allow the players to share the video and/or audio (see FIGS. 1-6).

The account server 470 is configured to control player-related accounts accessible via the wagering game system 400. The account server 470 can manage player financial accounts (e.g., performing funds transfers, deposits, withdrawals, etc.) and player information (e.g., avatars, screen name, account identification numbers, social contacts, financial information, etc.). The account server 470 can also provide auditing capabilities, according to regulatory rules, and track the performance of players, machines, and servers. The account server 470 can include an account controller configured to control information for player accounts. The account server 470 can also include an account store configured to store information for player accounts.

The community server 480 is configured to provide a wide range of services to members of virtual gaming communities. For example, the community servers may allow players to:

- Create Social Networks—When creating social networks, members can create electronic associations that inform network members when selected members are: 1) online, 2) performing activities, 3) reaching milestones, 4) etc.
- Establish a Reputation—Community members can establish reputations based on feedback from other community members, based on accomplishments in the community, based on who is in their social network, etc.
- Provide Content—Community members can provide content by uploading media, designing wagering games, maintaining blogs, etc.
- Filter Content—Community members can filter content by rating content, commenting on content, or otherwise distinguishing content.
- Interact with Other Members—Community members can interact via newsgroups, e-mail, discussion boards, instant messaging, etc.
- Participate in Community Activities—Community members can participate in community activities, such as multi-player games, interactive meetings, discussion groups, real-life meetings, etc.
- Connect Casino Players to Online Members—Community members who are playing in casinos can interact with members who are online. For example, online members may be able to: see activities of social contacts in the casino, chat with casino players, participate in community games involving casino players, etc.

In some embodiments, the community server 480 enables online community members (e.g., operating a personal computer (PC) or a mobile device) to participate in and/or monitor wagering games that are being presented in one or more casinos. The community server 480 can enable community members to connect with and track each other. For example, the community server 480 can enable community members to select other members to be part of a social network. The community server 480 can also enable members of a social network to track what other social network members are doing in a virtual gaming community and a real-world casino. For example, in some implementations, the community server 480 assists in enabling members of a social network to see when network members are playing wagering game tables and machines in a casino, accessing a virtual gaming community web site, achieving milestones (e.g., winning large wagers in a casino), etc.

The community server 480 can store and manage content for a virtual gaming community. For example, in some embodiments, the community server 480 can host a web site for a virtual gaming community. Additionally, the community server 480 can enable community members and administrators to add, delete, and/or modify content for virtual gaming communities. For example, the community server 480 can enable community members to post media files, member-designed games, commentaries, etc., all for consumption by members of a virtual gaming community.

The community server 480 can track behavior of community members. In some embodiments, the community server 480 tracks how individuals and/or groups use the services and content available in a virtual gaming community. The community server 480 can analyze member behavior and categorize community members based on their behavior. The community server 480 can configure network components to customize content based on individual and/or group habits.

The community server 480 can manage various promotions offered to members of a virtual gaming community. For example, the promotions community server 480 can distribute promotional material when members achieve certain accomplishments (e.g., scores for online games) in a virtual gaming community. Members may use some of the promotional material when playing wagering games in a casino.

The gaming machines 460 are configured to present wagering games and receive and transmit information to control the content that is presented for the wagering games. The gaming machines 460 can include input devices 461, a media processing unit 462, a game management unit 464, a content store 465, and a presentation unit 466. The input devices 461 may include buttons, joysticks, touch screens, cameras (e.g., camera 165 of FIG. 1), etc., used by players during wagering game sessions. The media processing unit 462 is configured to add markers and/or other identification information (e.g., round number, amount won, amount bet, etc.) to the video and/or audio captured by the camera of the gaming machine 460 prior to being sent to the wagering game server 450, and otherwise process media associated with wagering games as described herein. The game management unit 464 is configured to manage and control the game content that is presented on the gaming machine 460. The game management unit 464 can also generate game results based on random numbers received from the wagering game server 450, or may communicate with the wagering game server 450 to obtain the game results. The content store 465 is configured to store content that is presented on the wagering game machine 460. The presentation unit 466 is configured to control the presentation of the game content on the wagering game machine 460. The presentation unit 466 can include one or more browsers and any other software and/or hardware suitable for presenting audio and video content. It is noted, however, that in other implementations the game content can be presented using other display technologies.

The gaming machines 460 described herein can take any suitable form, such as floor standing models, handheld mobile units, bartop models, workstation-type console models, etc. Further, the gaming machines 460 can be primarily dedicated for use in conducting wagering games, or can include non-dedicated devices, such as personal computers (PC), mobile phones, personal digital assistants (PDAs), laptop computers, etc.

In some embodiments, each of the gaming machines 460 and the wagering game server 450 are configured to work together such that the gaming machine 460 can be operated as a thin, thick, or intermediate client. For example, one or more elements of game play may be controlled by the gaming machine 460 (client) or the wagering game server 450 (server). Game play elements can include executable game code, lookup tables, configuration files, game results, audio or visual representations of the game, game assets or the like. In a thin-client example, the wagering game server 450 can perform functions such as determining game results or managing assets, while the gaming machine 460 can present a audible/graphical representation of such outcome or asset modification to the players. In a thick-client example, the gaming machine 460 can determine game outcomes and communicate the outcomes to the wagering game server 450 for recording or managing a player's account.

In some embodiments, either the gaming machines 460 or the wagering game server 450 can provide functionality that is not directly related to game play. For example, account transactions and account rules may be managed centrally (e.g., by the wagering game server 450) or locally (e.g., by the gaming machine 460). Other functionality not directly related to game play may include power management, presentation of advertising, software or firmware updates, system quality or security checks, etc.

As described above, in some embodiments, the wagering game system architecture 400 can include an online wagering game server 495 and a plurality of online gaming machines 460. The online gaming machines 460 can be various types of systems that are configured to connect to the Internet 492, e.g., a personal computer (PC), a mobile phone, a laptop computer, etc. to play wagering games in an online casino or to remotely participate in wagering games being played in a physical casino. In some embodiments, the online wagering game server 495 can work in conjunction with the wagering game server 450 to obtain media associated with wagering games played by players (either in online casinos or physical casinos), edit the media, and allow players to share the media, as described herein.

Each component shown in the wagering game system architecture 400 is shown as a separate and distinct element connected via a communications network 455. However, some functions performed by one component could be performed by other components. For example, the wagering game server 450 can be configured to perform some or all of the functions of the account server 470, the wagering game server 450 can be configured to perform some or all of the functions of the online wagering game server 495, and/or the game management unit 452 can be configured to perform some or all of the functions of the media management unit 456. Additionally, the components shown may all be contained in one device, but some, or all, may be included in, or performed by multiple devices, as in the configurations shown in FIG. 4 or other configurations not shown. Furthermore, the wagering game system architecture 400 can be implemented as software, hardware, any combination thereof, or other forms of embodiments not listed. For example, any of the network components (e.g., the wagering game tables, machines, servers, etc.) can include hardware and machine-readable media including instructions for performing the operations described herein. Machine-readable media includes any mechanism that provides (i.e., stores and/or transmits) information in a form readable by a machine (e.g., a wagering game table, machine, computer, etc.). For example, tangible machine-readable storage media includes read only memory (ROM), random access memory (RAM), magnetic disk storage media, optical storage media, flash memory machines, and other types of tangible storage medium suitable for storing instructions. Machine-readable transmission media also includes any media suitable for transmitting software over a network.

Although FIG. 4 describes some embodiments, the following sections describe many other features and embodiments.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 5:
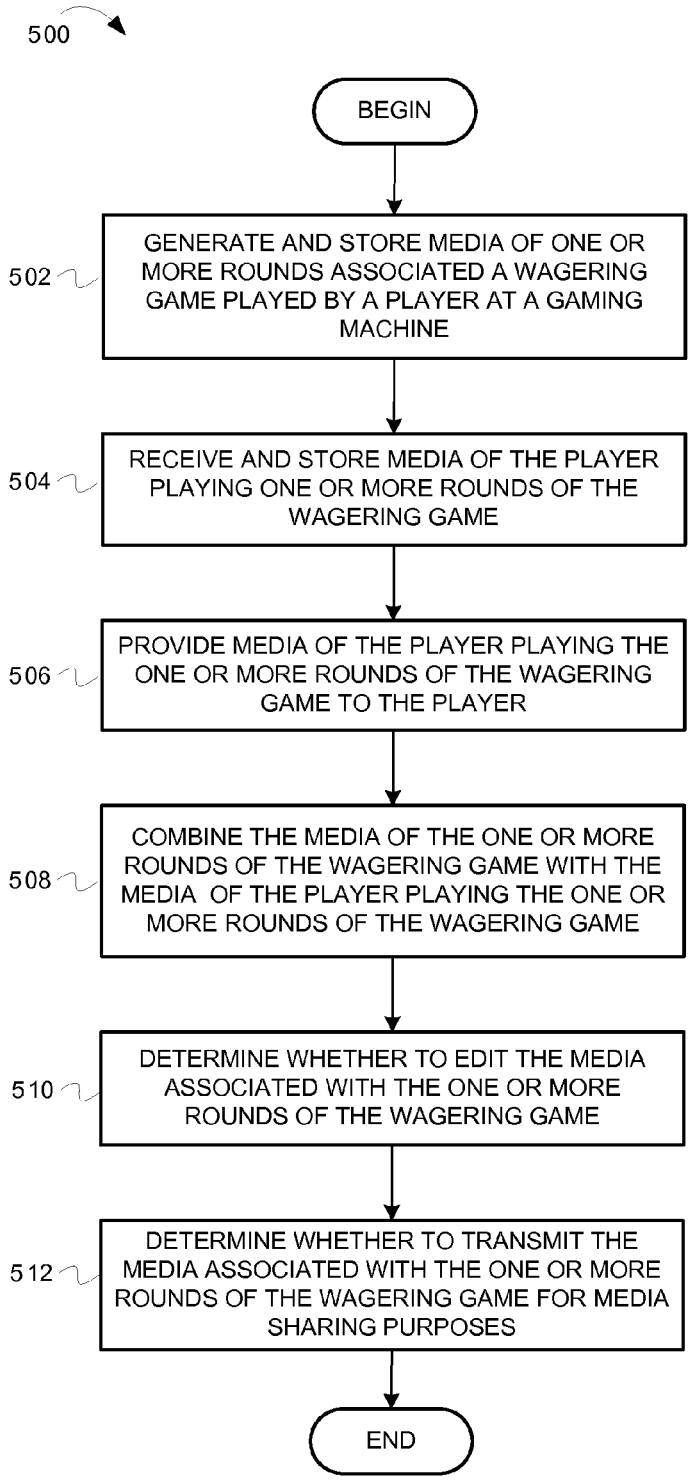
FIG. 5 is a flow diagram illustrating operations for processing and enhancing media associated with wagering games played in a wagering game system, according to some embodiments.
Figure 6:
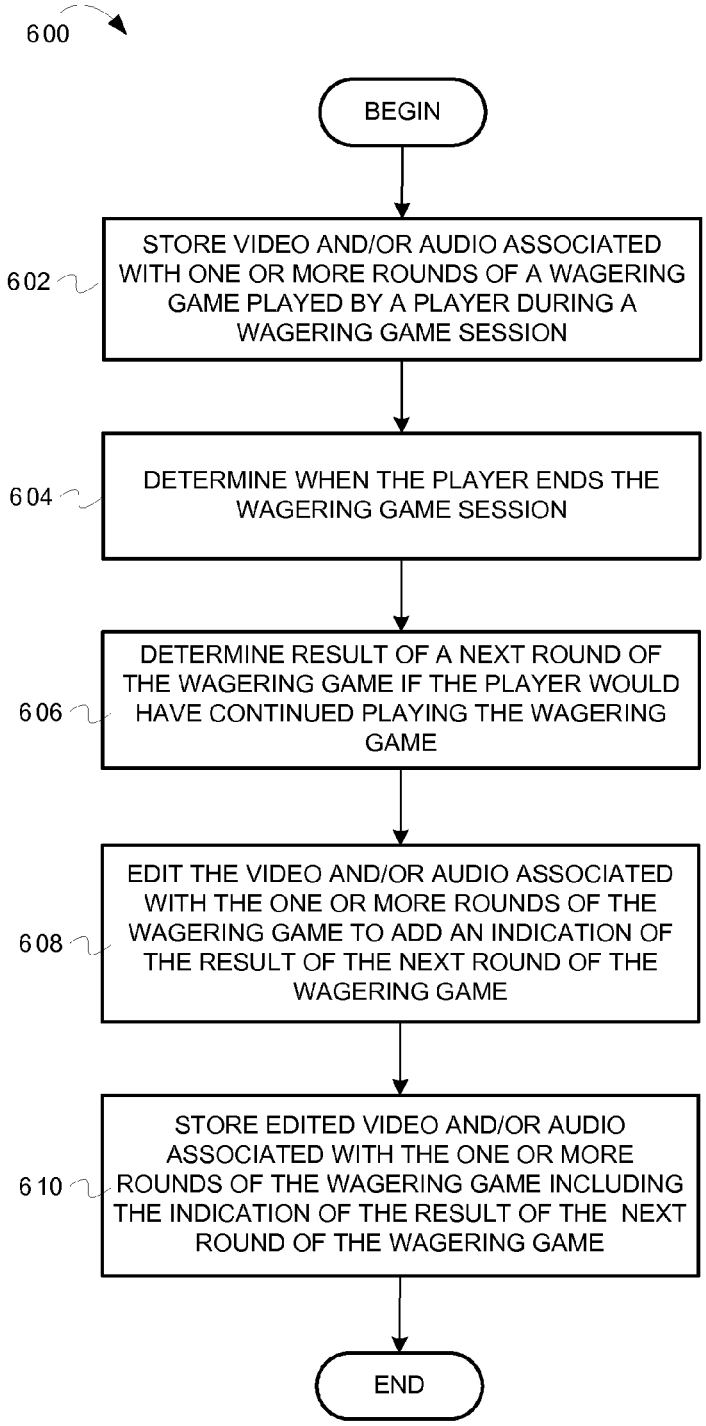
FIG. 6 is a flow diagram illustrating operations for editing and enhancing media associated with wagering games played in a wagering game system, according to some embodiments.

The following discussion of FIGS. 5 and 6 describe example mechanisms for enhancing media associated with a wagering game played by a player.

FIG. 5 is a flow diagram ("flow") 500 illustrating operations for processing and enhancing media associated with wagering games played in a wagering game system, according to some embodiments. The flow of 500 will be described with reference to the example system architecture of FIG. 4. The flow diagram begins at block 502.

At block 502, the wagering game server 450 generates and stores media of one or more rounds of a wagering game played by a player at a gaming machine 460. In some implementations, the media management unit 456 of the wagering game sever 450 generates video and/or audio of the one or more rounds of the wagering game that the player played at the gaming machine 460, i.e., generates video of some or all of the game content displayed to the player during the one or more rounds of the wagering game, and/or generates audio of some or all of the sounds associated with the wagering game. The game content displayed to the player can include the game environment, game elements, game activity, game panel information (e.g., bet amount, balance, etc.), game results, and other game-related content associated with the wagering game. The sounds associated with the wagering game may include the sound effects of a spinning reel, the sounds effects when playing cards are dealt, the sound effects during a celebration of a win, etc. The video and audio of the wagering game can attempt to recreate the gaming experience for the player by incorporating the same or similar types of lighting and sounds, respectively, that the player experienced at the gaming machine 460. In some examples, the media management unit 456 can generate high definition video and/or audio for the one or more rounds of the wagering game. In some implementations, the media management unit 456 can generate the video and/or audio associated with the wagering game based, at least in part, on information known about the game (e.g., game environment, game elements, etc.) and the game content (e.g., account information, game results, etc.) provided from the wagering game server 450 to the wagering game server 460 during the wagering game session. In some implementations, the media management unit 456 can also generate the video and/or audio associated with the wagering game also based on game-related information received from the gaming machine 460 (e.g., audio/video data, player input data, etc.). The media management unit 456 may store the generated media in a storage unit of the wagering game server 450 (e.g., content store 454), in a storage unit of the account server 470, and/or in a storage unit of the community server 480. After block 502, the flow continues at block 504.

At block 504, the wagering game server 450 receives and stores media of the player playing one or more rounds of the wagering game at the gaming machine 460. For example, the media management unit 456 can receive video and/or audio of the player playing one or more rounds of the wagering game. As described above with reference to FIG. 1, in some implementations, during the wagering game session the player selects one or more of the rounds of the wagering game that the player wants to save, and the gaming machine 460 can provide the video and/or audio of the player playing the selected one or more rounds to the media management unit 456. In some implementations, the gaming machine 460 provides, to the media management unit 456, all of the video and/or audio captured of the player playing all of the rounds of the wagering game during the wagering game session. As described above, the gaming machine 460 that captures (e.g., via a camera) and provides the media to the wagering game server 450 may be a gaming machine (e.g., a mobile device, dedicated wagering game machine, kiosk, etc.) in a physical casino, or a gaming machine outside a physical casino (e.g., a PC, mobile phone, laptop, etc. at a player's home) used to play wagering games in an online casino. It is noted that in some implementations the gaming machine 460 can similarly capture and provide still images of the player playing the wagering game to the wagering game server 450. The media management unit 456 may store the generated media (video, audio, still images, etc.) in a storage unit of the wagering game server 450 (e.g., content store 454), in a storage unit of the account server 470, and/or in a storage unit of the community server 480. After block 504, the flow continues at block 506.

At block 506, the wagering game server 450 provides media of the player playing the one or more rounds of the wagering game to the player. For example, the media management unit 456 can email or text the video and/or audio of the player playing the one or more rounds of the wagering game that was saved for the player at the wagering game controller 410 (e.g., see block 504). In another example, the media management unit 456 can email or text a link to the video and/or audio, and/or a notification message that the video and/or audio is available for the player to access at the wagering game server 450. After block 506, the flow continues at block 508.

At block 508, for the one or more rounds of the wagering game saved for the player, the wagering game server 450 combines media of the one or more rounds of the wagering game with media of the player playing the one or more rounds of the wagering game. In one implementation, the media management unit 456 combines video and/or audio of the one or more rounds of the wagering game with the received video and/or audio of the player playing the one or more rounds of the wagering game. The media management unit 456 can combine the media in various ways. For example, the media management unit 456 can overlay the video of a round of the wagering game with the corresponding video of player playing the round of the wagering game. In another example, the media management unit 456 can combine the videos to create a single split screen video, such that during playback a portion of the screen (e.g., predefined percentage, such as 50% or 60%) presents the video of the round of the wagering game and the remaining portion of the screen (e.g., a predefined percentage, such as 40% or 50%) presents the video of the player playing the round of the wagering game. It is noted, however, that in other examples the media management unit 456 can combine the videos by other techniques, e.g., the media management unit 456 can cut and mix the videos such that at first the video of the round of the wagering game is shown and, after the results, the video of the player's reaction to the results is shown. Additionally, the media management unit 456 can add audio to the combined video in various ways, or leave off all audio. In one example, the media management unit 456 can mix the audio of the round of the wagering game with the audio of the player playing the round of the wagering game, and then add the mixed audio to the combined video. In another example, the media management unit 456 can only add the audio of the player playing the round of the wagering game to the combined video, or only add the audio of the round of the wagering game to the combined video.

In one implementation, the media management unit 456 automatically combines the media according to default settings to offer the player access to enhanced media content. For example, the default settings at the wagering game server 450 may be to overlay the video of the round of the wagering game with the video of the player playing the round of the wagering game, and add only the audio of the player playing the wagering game. When the player accesses the combined media content, the player can edit the content as desired. In another implementation, the media management unit 456 automatically combines the media according to settings configured by the player. In yet another implementation, the media management unit 456 waits to receive instructions from the player (e.g., when the player accesses the media online) that specifies how to combine the media. The media management unit 456 then stores the combined media content.

In one implementation, the media management unit 456 detects markers, indicating the start and end of each round, embedded in the received video and/or audio of the player playing the wagering game. The media management unit 456 also detects other embedded identification information associated with each round, e.g., a round number, a win amount, a bet amount, etc. In one example, the wagering game server 450 may receive video and/or audio of the player playing 5 rounds of the wagering game. In this example, the wagering game server 450 may identify the start and end of each round according to the embedded markers, and may identify which rounds the media is associated with according to the embedded identification information (e.g., round number, win amount, bet amount, etc.). It is noted, however, that the start/end of each round in media and/or the identification of which round the media is associated with can be accomplished by other techniques, e.g., the media management unit 456 can identify the start of a round of the wagering game by detecting data embedded within the media indicating that the player pressed a start button or a spin button, or indicating when the player pressed the record button at the gaming machine 460. After block 508, the flow continues at block 510.

At block 510, the wagering game server 450 can determine whether to edit the media associated with the one or more rounds of the wagering game. In some implementations, the media management unit 456 can automatically edit the separate video and/or audio content associated with the wagering game, or the combined video and/or audio content (e.g., combined as described above in block 508). For example, the media management unit 456 can add content to the media associated with the one or more rounds of the wagering game, e.g., edit video associated with a wagering game to add an indication (e.g., text, graphics, or video) of what the result of the next one or more rounds would have been if the player did not end the wagering game session, as will be further described below with reference to FIG. 6. The media management unit 456 can also add other content to the media, e.g., embed text of game-related statistics and other information within the video of the wagering game, such as amount bet in each round, amount won/lost in each round, game strategy employed in each round, type of wagering game, location, total amount won/lost on the day, etc. The media management unit 456 can also add markers to indicate certain events associated with the wagering game, e.g., add a marker to indicate the start of the round of the wagering game, add a marker to indicate the end of the round, add a marker to indicate when a hand is dealt in a wagering game that incorporates playing cards, add a marker to indicate when the results of the round are presented, etc. The media management unit 456 can edit the media associated with the wagering game according to default settings, and/or according to settings configured by the player.

In some implementation, the wagering game server 450 can provide access to the player (e.g., via network 455 and/or the Internet 492) to the separate video and/or audio content associated with the wagering game, and also provide access to any combined video and/or audio content (e.g., combined as described above in block 508). The wagering game server 450 can allow the player to edit the media content, e.g., via an online media editing tool. For example, the media management unit 456 can provide an online media editing tool to allow the player to personalize and customize the video and/or audio, e.g., add text captions, add voice-over commentary, create an electronic card (e-card) including some of the media, add game-related statistics, add graphics, etc. The media management unit 456 may also allow the player to specify how the player wants to combine the different media associated with the wagering game, e.g., similarly as described above in block 508, and may allow the player to otherwise cut, enhance, or otherwise modify the media, e.g., remove all audio, cut certain parts of the video/audio, add markers to indicate certain game-related events, etc. After block 510, the flow continues at block 512.

At block 512, the wagering game server 450 determines whether to transmit the media associated with the one or more rounds of the wagering game for media sharing purposes. In some implementations, the media management unit 456 can automatically transmit the media for media sharing purposes, e.g., after receiving and editing the media. The media management unit 456 can determine whether to, and where to, transit the media based on default settings or settings configured by the player. In some implementations, besides allowing the player to access and edit the media associated with the wagering game, the media management unit 456 can allow the player to share the media, e.g., after accessing and editing the media. For example, the media management unit 455 may provide an online media sharing tool that allows the player to provide the media to friends, post the media in a gaming community website, post the media to a social networking website (e.g., Facebook®, MySpace®, etc.). In one example, the online media sharing tool can allow the player to easily email or text the media to the player's friends or buddies that are part of a gaming community, and/or email or text a link to access the media. The online media sharing tool can allow the player to post the media to a gaming community website, e.g., hosted at the wagering game server 450 or the community server 480. The online gaming community website can organize the media received from players by wagering game type, amount won, location, etc., and/or by player-created tags, e.g., funny, big win, over-the-top, etc. The online gaming community website can allow players to rate the media of other players, and may host tournaments or contests that provide monetary or non-monetary awards to the highest rated media. Furthermore, the online media sharing tool can allow the player to interface with social networking websites, e.g., Facebook, MySpace, etc., to post the media, and send out alerts to friends to access the media. In one example, the online media sharing tool can allow the player to easily upload the media to one or more social networking websites, set privacy settings for the media, send out email alerts to friends to access the media, add a link to the media within the player's wagering game system account (e.g., in the player's profile), etc. It is noted, however, that the media management unit 456 can allow the player to share the media by various other methods, e.g. post the media to blogs, media sharing websites (e.g., YouTube®, Flickr®, etc.), personal websites, etc. In some implementations, the media management unit 456 may also use the media for advertisement or promotional purposes. For example, the media management unit 456 may obtain permission from the player to display video and audio of the player's celebration of a big win for particular wagering game in LCD televisions across the casino floor, or within an online casino website. In some examples, the media management unit 456 may offer players free spins, bonuses, merchandise, or other prizes for giving the casino operator permission to use the media. After block 512, the flow ends.

In some implementations, the wagering game server 450 can receive video and/or audio of multiple players playing a wagering game, e.g., multiple friends playing the same wagering game. The media management unit 456 can then combine (e.g., overlay) the received video and/or audio of the multiple players with the video of the rounds of the wagering game played by each player. For example, if 5 friends are playing a slots wagering game, for each player, the media management unit 456 can overlay the video of the rounds of the slots wagering game with the video and/or audio of each of the 5 players playing the slots wagering game. In one implementation, the media management unit 456 can store the combined video. In one implementation, the media management unit 456 can also stream the video of each of the players playing the wagering game to each of the corresponding gaming machines, so that each player can view video of other players while playing the game. Furthermore, similar the examples described herein with reference to FIGS. 1-6, the media management unit 456 can edit the combined media of the multiple players to enhance the media, can allow each player to edit the combined media, can transmit the combined media to each player (e.g., via email), can allow each player to share the combined media (e.g., upload the media to a social networking website), etc.

In some implementations, the wagering game server 450 can provide access to the media to moderators. For example, the operator of the wagering game system can employ moderators to review all of the media content that is generated and stored, in order to ensure that the media content is acceptable and meets the standards set by the operator. The wagering game server 450 may allow the moderators to delete media content that is deemed inappropriate and notify the player (e.g., send information about the operator's policy to the player, provide a warning to the player, limit the player's media posting privileges, etc.).

FIG. 6 is a flow diagram ("flow") 600 illustrating operations for editing and enhancing media associated with wagering games played in a wagering game system, according to some embodiments. The flow of 600 will be described with reference to the example system architecture of FIG. 4. The flow diagram begins at block 602.

At block 602, the wagering game server 450 stores video and/or audio associated with one or more rounds of a wagering game played by a player during a wagering game session at a gaming machine 460. As described above with reference to FIG. 5, the media management unit 456 of the wagering game server 450 can generate and store video and/or audio of the one or more rounds of the wagering game, i.e., video of some or all of the game content displayed to the player during the one or more rounds of the wagering game, and/or audio of some or all of the sounds associated with the wagering game. The media management unit 456 can also receive video and/or audio of the player playing the one or more rounds of the wagering game from the gaming machine 460, e.g., video and/or audio captured by a camera at the gaming machine. After block 602, the flow continues at block 604.

At block 604, the wagering game server 450 determines when the player ends the wagering game session at the gaming machine 460. In one implementation, the game management unit 452 determines when the player ends the wagering game session associated with the wagering game, e.g., the game management unit 452 detects when the player logs out, the player removes the player card, the player enters input indicating the end of the session, or the player begins playing a different wagering game, etc. After block 604, the flow continues at block 606.

At block 606, the wagering game server 450 determines what would have been the result of a next round of the wagering game if the player would have continued playing the wagering game at the gaming machine 460 without ending the wagering game session. In one implementation, the game management unit 452 determines the result of the next round of the wagering game if the player would have not ended the wagering game session. For example, the game management unit 452 uses a random numbers generator to determine the results of the next round of the wagering game. In some examples, the game management unit 452 may also use additional information about the state of the wagering game when the player ended the wagering game session to determine the results of the next rounds. For example, for a slots wagering game, the game management unit 452 can detect the state of the reels (e.g., the previous results) and use this information along with the random numbers to determine what would have been the result of the next spin if the player would not have ended the wagering game session. In some implementations, the game management unit 452 may similarly determine what would have been the results of the next two or three rounds (or a programmable number of rounds) if the player would not have ended the wagering game session. After block 606, the flow continues at block 608.

At block 608, the wagering game server 450 edits the video and/or audio associated with the one or more rounds of the wagering game to add an indication of the result of the next round of the wagering game. In one implementation, the media management unit 456 edits the video of the one or more rounds of the wagering game to add the indication of the result of the next round of the wagering game. In another implementation, as described above with reference to FIG. 5, the media management unit 456 can combine the video and/or audio of the one or more rounds of the wagering game with the video and/or audio of the player playing the one or more rounds of the wagering game. The media management unit 456 can then add the indication of the result of the next round to the combination video. In one example, the indication of the result of the next round of the wagering game may be video of the next round of the wagering game. For example, after determining the result of the next round, the media management unit 456 can generate video of the game content (e.g., game elements, game results, etc.) that would have been displayed to the player during the next round of the wagering game if the player would have continued playing the wagering game. The media management unit 456 can then combine the video showing the results of the next round with the video associated with the wagering game played by the player, e.g., add the video showing the result of the next round to the end of the original video, overlay the original video with the video showing the results of the next round, or use other techniques to combine the videos in some manner. In another example, the indication of the result of the next round can be text and/or graphics indicating the results of the next round. In this example, text and/or graphics can be embedded at the end of the original video, or can be added to the original video by other techniques. In some implementations, the media management unit 456 can edit the video associated with the one or more rounds of the wagering game to add an indication of the results of the next two or more rounds of the wagering game if the player would have continued playing the wagering game. After block 608, the flow continues at block 610.

At block 610, the media management unit 456 stores the edited video and/or audio associated with the one or more rounds of the wagering game including the indication of the result of the next round of the wagering game. Furthermore, similar to blocks 510 and 512 of FIG. 5, the media management unit 456 may determine whether to further edit the media and/or transmit the media for sharing purposes (e.g., according to player instructions). After block 610, the flow ends.

In some implementations, the wagering game server 450 may receive video and audio of the next player that played the wagering game at the gaming machine 460. The media management unit 456 may add the video and audio of the next player to the combined video that is generated for the original player. This may indicate to the original player whether he would have won if the player did not end the wagering game session.

Additional Example Operating Environments

This section describes example operating environments, systems and networks, and presents structural aspects of some embodiments.

Wagering Game Machine Architecture

Figure 7:
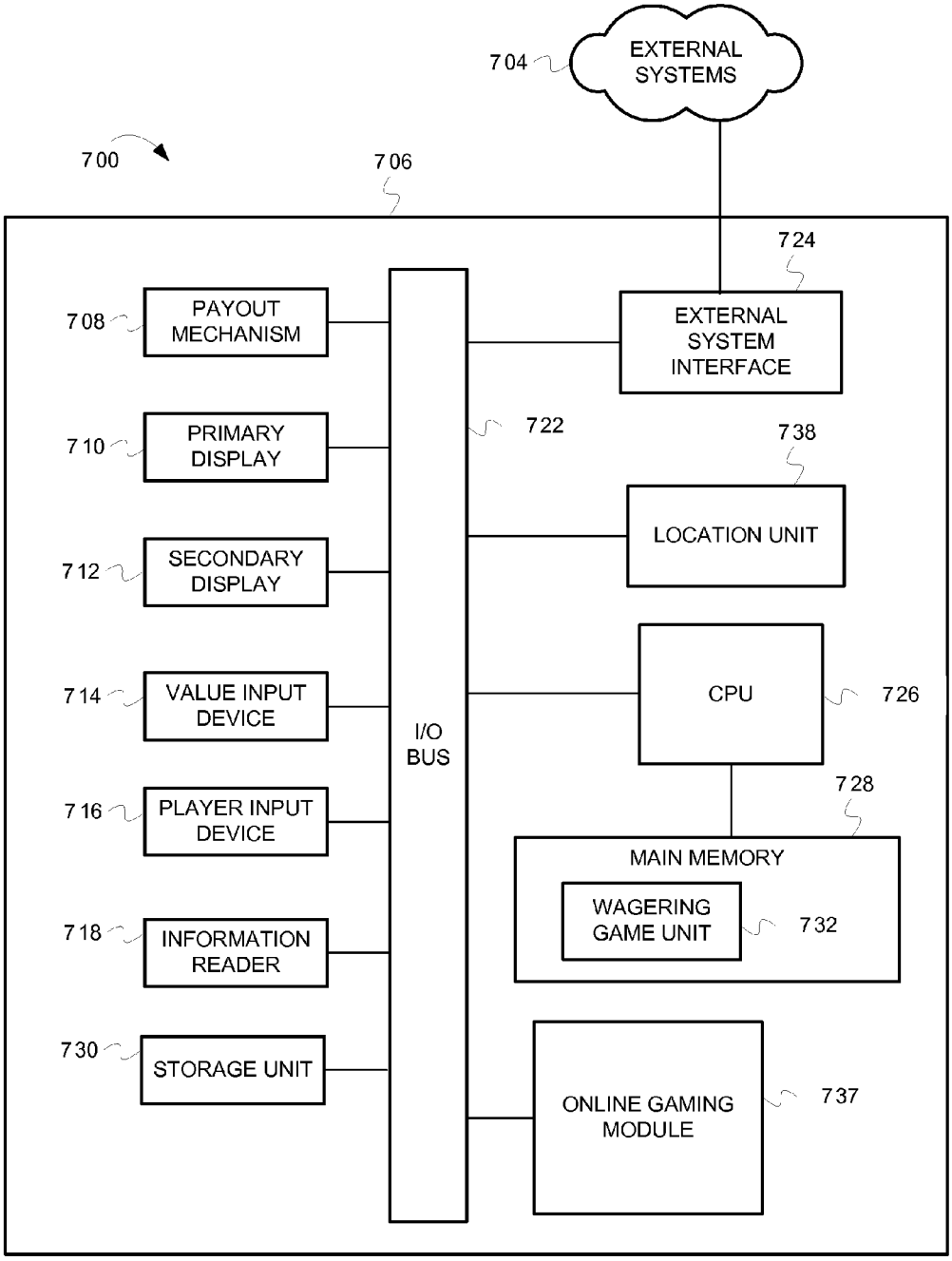
FIG. 7 is a conceptual diagram that illustrates an example of a wagering game machine architecture, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part, e.g., as described above with reference to FIGS. 1-6.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites.

In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes an online gaming module 737. The online gaming module 737 can process communications, commands, or other information, where the processing can control and present online wagering games. In some embodiments, the online gaming module 737 can work in concert with the wagering game unit 732, and can perform any of the operations described above.

Furthermore, any component of the wagering game machine 706 can include hardware, firmware, and/or machine-readable media including instructions for performing the operations described herein.

Example Wagering Game Machines

Figure 8:
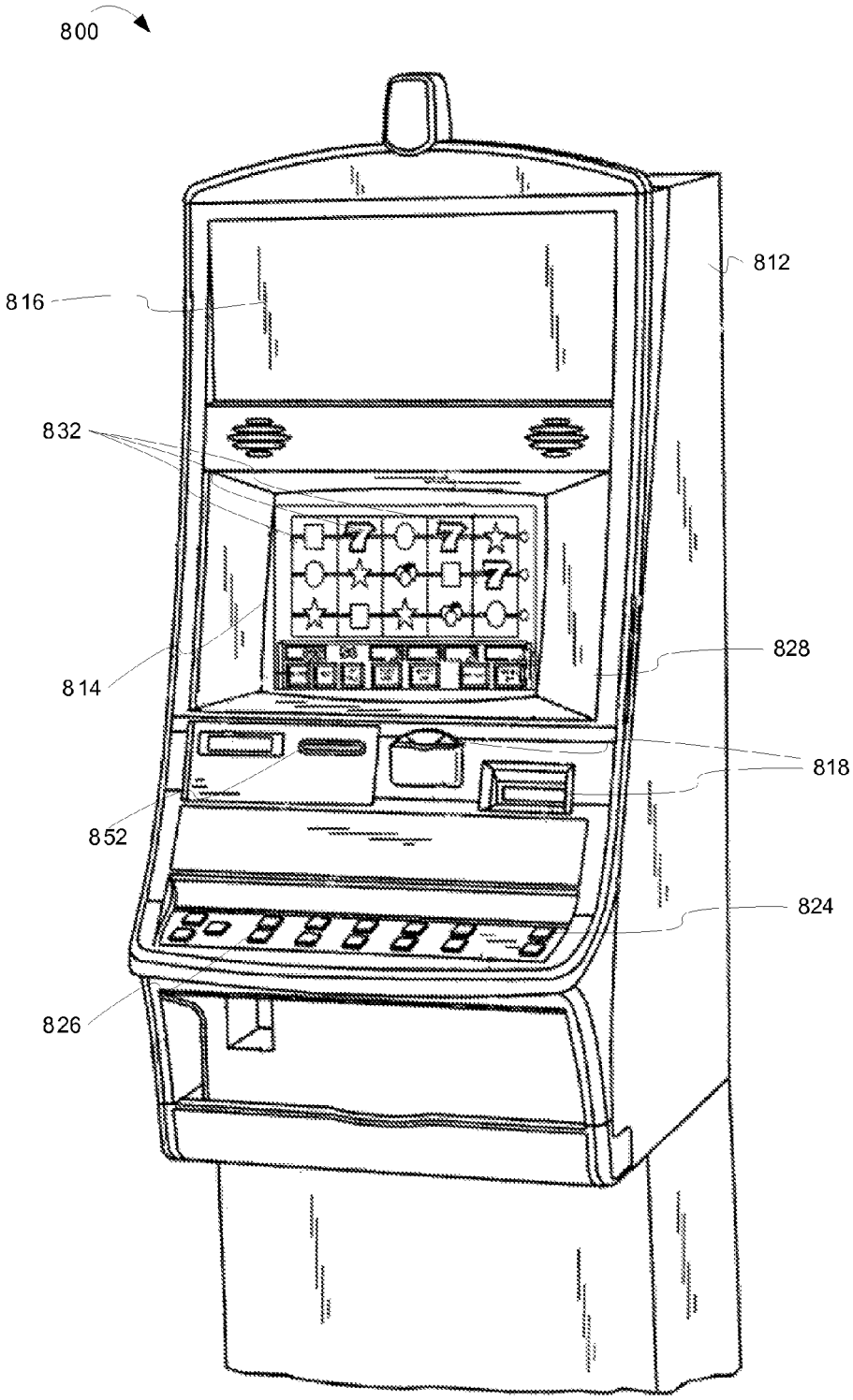
FIG. 8 is a perspective view of a wagering game machine, according to some embodiments.

FIG. 8 is a perspective view of a wagering game machine, according to example embodiments. Referring to FIG. 8, a wagering game machine 800 is used in gaming establishments, such as casinos. In some embodiments, the wagering game machine 800 can implement the functionality described above in FIGS. 1-7.

According to embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. In some implementations, the primary display 814 can also display information about a bonus wagering game and a progressive wagering game. The wagering game machine 800 also includes a secondary display 816 for displaying bonus wagering games, wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bartop model, mobile handheld model, or workstation console model.

A player begins playing a basic wagering game by making a wager via the value input device 818. The player can initiate play by using the player input device's buttons or touch screen 828. The basic game can include arranging a plurality of symbols along a payline 832, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A computer-implemented method comprising:

transmitting game content from a wagering game server to a gaming machine via a network to present a wagering game at the gaming machine for a player;

generating and storing, at the wagering game server, video of the wagering game during a wagering game session;

receiving, at the wagering game server via the network, video of the player playing the wagering game during the wagering game session;

generating, at the wagering game server, the video of the wagering game during the wagering game session combined with the video of the player playing the wagering game during the wagering game session to form a combined video;

detecting an end to the wagering game session;

determining, after the end of the wagering game session, a result of a next round of the wagering game;

adding, to the combined video, an indication of the result of the next round of the wagering game; and storing, at the wagering game server, the combined video.

2. The method of claim 1, wherein said generating and storing video of the wagering game during the wagering game session comprises generating video of game content presented at the gaming machine during the wagering game session and storing the video at the wagering game server.

3. The method of claim 1, wherein said receiving video of the player the wagering game during the wagering game session comprises receiving video, captured via a camera of the gaming machine, of the player playing the wagering game during the wagering game session from the gaming machine.

4. The method of claim 1, wherein said receiving video of the player playing the wagering game during the wagering game session comprises receiving video, captured via a camera of a mobile device, of the player playing the wagering game during the wagering game session.

5. The method of claim 1, wherein the combined video comprises overlaying the video of the wagering game during the wagering game session with the video of the player playing the wagering game during the wagering game session.

6. The method of claim 1, wherein the combined video comprises generating a split-screen video comprising the video of the wagering game during the wagering game session and the video of the player playing the wagering game during the wagering game session.

7. The method of claim 1, wherein the adding, to the combined video, an indication of the result of the next round of the wagering game comprises video of a simulation of the next round of the wagering game.

8. The method of claim 1, further comprising detecting, at the wagering game server, an indication to generate and store video of the wagering game during the wagering game session based on player input provided at the gaming machine by the player.

9. The method of claim 1, wherein said storing the combined video comprises storing the combined video at the wagering game server and one or more of providing the player access to view the combined video, providing the player access to an online editing tool to edit the combined video, and providing the player access to an online sharing tool to upload the combined video to one or more online websites.

10. The method of claim 1, further comprising emailing the combined video or a link to the combined video to an email account associated with the player.

11. A wagering game system comprising:

a gaming machine configured to present a wagering game in one or more displays of the gaming machine for a player, and configured to:

capture video of the player playing a plurality of rounds of the wagering game at the gaming machine during a wagering game session;

determine that the player wants to save the video of the player playing one or more of the plurality of rounds of the wagering game;

provide the video of the player playing the one or more rounds of the wagering game to a wagering game server via a network; and the wagering game server configured to generate and store video of the one or more rounds of the wagering game, and configured to:

receive, via the network, the video of the player playing the one or more rounds of the wagering game from the gaming machine;

combine the video of the one or more rounds of the wagering game with the video of the player playing the one or more rounds of the wagering game;

detect an indication of when the player ends the wagering game session associated with the wagering game;

determine a result of a next round of the wagering game if the player would not have ended the wagering game session;

add, to the combined video, an indication of the result of the next round of the wagering game;

store.

12. The wagering game system of claim 11, wherein the gaming machine configured to determine that the player wants to save the video comprises the gaming machine receiving player input indicating the player wants to save the video.

13. The wagering game system of claim 11, wherein the indication of the result of the next round of the wagering game comprises a video of the next round of the wagering game.

14. A computer-implemented method comprising:

transmitting game content from a wagering game server to a gaming machine via a network to present a wagering game at the gaming machine for a player during a wagering game session;

storing, at the wagering game server, video of one or more rounds of the wagering game played during the wagering game session to provide access to the video to a player account associated with the player;

detecting, at the wagering game server, an indication of when the player ends the wagering game session associated with the wagering game;

determining a result of a next round of the wagering game if the player would not have ended the wagering game session; and editing the video of the one or more rounds of the wagering game to add an indication of the result of the next round of the wagering game.

15. The method of claim 14, further comprising generating a video of the result of the next round of the wagering game.

16. The method of claim 15, wherein said editing the video of the one or more rounds of the wagering game to add an indication of the result of the next round of the wagering game comprises combining the video of the one or more rounds of the wagering game with the video of the result of the next round of the wagering game.

17. A wagering game server comprising:

means for transmitting game content from a wagering game server to a gaming machine via a network to present a wagering game at the gaming machine for a player during a wagering game session;

means for storing video of one or more rounds of the wagering game played during the wagering game session;

means for determining when the player ends the wagering game session associated with the wagering game;

means for determining a result of a next round of the wagering game if the player would not have ended the wagering game session; and means for editing the video of the one or more rounds of the wagering game to add an indication of the result of the next round of the wagering game.

18. The wagering game server of claim 17, wherein said means for editing the video of the one or more rounds of the wagering game to add an indication of the result of the next round of the wagering game comprises means for combining the video of the one or more rounds of the wagering game with a video of the result of the next round of the wagering game.

19. One or more non-transitory machine-readable storage media, having instructions stored therein, which, when executed by one or more processors causes the one or more processors to perform operations that comprise:

transmitting game content from a wagering game server to a gaming machine via a network to present a wagering game at the gaming machine for a player;

generating and storing video of one or more rounds of the wagering game during a wagering game session;

receiving video of the player playing the one or more rounds of the wagering game;

combining the video of the one or more rounds of the wagering game with the video of the player playing the one or more rounds of the wagering game;

detecting an indication of when the player ends the wagering game session;

determining a result of a next round of the wagering game if the player would not have ended the wagering game session;

adding, to the combined video, an indication of the result of the next round of the wagering game; and storing the combined video.

20. The non-transitory machine-readable storage media of claim 19, wherein said operation of generating and storing video of the one or more rounds of the wagering game comprises generating video of game content presented to the player at the gaming machine during the one or more rounds of the wagering game and storing the video at the wagering game server.

21. The non-transitory machine-readable storage media of claim 19, wherein said operation of combining the video of the one or more rounds of the wagering game with the video of the player playing the one or more rounds of the wagering game comprises overlaying the video of the one or more rounds of the wagering game with the video of the player playing the one or more rounds of the wagering game.

22. The non-transitory machine-readable storage media of claim 19, wherein said operation of combining the video of the one or more rounds of the wagering game with the video of the player playing the one or more rounds of the wagering game comprises generating a split-screen video comprising the video of the one or more rounds of the wagering game and the video of the player playing the one or more rounds of the wagering game.

23. The non-transitory machine-readable storage media of claim 19, wherein the indication of the result of the next round of the wagering game comprises a video of the next round of the wagering game.

* * * * *